US009793595B1

(12) United States Patent
Padin et al.

(10) Patent No.: US 9,793,595 B1
(45) Date of Patent: Oct. 17, 2017

(54) TRANSPARENT MESH ANTENNA FOR ELECTRONIC DEVICE HAVING A GRAPHICAL DISPLAY

(71) Applicant: VSN TECHNOLOGIES, INC., Fort Lauderdale, FL (US)

(72) Inventors: Guillermo Padin, Coral Springs, FL (US); Amit Verma, Sunrise, FL (US); Tal Mor, Coral Springs, FL (US); Vinosh Diptee, Fort Lauderdale, FL (US); Julio A. Abdala, Fort Lauderdale, FL (US)

(73) Assignee: Hoyos VSN Corp., San Juan, PR (US)

( * ) Notice: Subject to any disclaimer, the term of this patent is extended or adjusted under 35 U.S.C. 154(b) by 420 days.

(21) Appl. No.: 14/480,840

(22) Filed: Sep. 9, 2014

(51) Int. Cl.
*H01Q 1/22* (2006.01)
*H01Q 1/36* (2006.01)

(52) U.S. Cl.
CPC ..... *H01Q 1/22* (2013.01); *H01Q 1/36* (2013.01)

(58) Field of Classification Search
CPC ..... H01Q 1/22; H01Q 1/36
See application file for complete search history.

(56) References Cited

U.S. PATENT DOCUMENTS

2006/0139833 A1* 6/2006 Ranta ..... H01Q 1/246 361/113
2010/0001975 A1* 1/2010 Jiang ..... G06F 1/1626 345/174
2013/0059532 A1* 3/2013 Mahanfar ..... H04B 5/0031 455/41.1
2014/0106684 A1* 4/2014 Burns ..... H01Q 1/243 455/78
2014/0139379 A1* 5/2014 Bolin ..... H01Q 9/06 343/702

* cited by examiner

*Primary Examiner* — Dieu H Duong
*Assistant Examiner* — Bamidele A Jegede
(74) *Attorney, Agent, or Firm* — Patents on Demand P.A.; Brian K. Buchheit

(57) ABSTRACT

A transparent metal mesh is used as an antenna element and is disposed over a graphical display so that the graphical display can be seen through the transparent metal mesh. A radio circuit is coupled to the metal mesh to receive radio signals using the transparent metal mesh. In some embodiments the radio circuit can also transmit signals using the transparent metal mesh as an antenna.

15 Claims, 4 Drawing Sheets

TRANSPARENT MESH ANTENNA FOR ELECTRONIC DEVICE HAVING A GRAPHICAL DISPLAY

FIELD OF THE DISCLOSURE

The present disclosure relates generally to antennas for electronic devices, and more particularly to transparent antennas which allow light to pass through them.

BACKGROUND

A large number of portable electronic devices include radio circuitry in order to receive information from external sources. Many devices include transmitters as well, which are paired with a receiver to form a transceiver, to communicate using a particular radio protocol. A necessary component for radio reception and communication is an antenna, which, at one time, was an obvious part of a device that included a radio circuit since the antenna was an external component. Presently, however, the preference is that the antenna is not seen, and is thus an internal element of the device.

The use of internal or hidden antennas is somewhat at odds with other preferences in the design of portable electronic devices, such as reducing size. This is further complicated in more sophisticated devices such as mobile phone devices (e.g. "smartphones") since they can include several different radio circuits for different communication protocols. For example, a typical mobile phone device present sold will include a cellular transceiver for communicating with a cellular network, a wireless local area network (WLAN—sometimes referred to as "WiFi"), a personal area network (PAN), a satellite positioning system, and near field communication. As a result, present day devices can include several antennas. Given that the preference for the styling of portable electronic devices is to locate antennas internally, locating multiple antennas inside a device creates a challenge.

Accordingly, there is a need for an antenna arrangement that utilizes the available space inside a device while minimizing the need to increase the size of the device.

BRIEF DESCRIPTION OF THE FIGURES

In the accompanying figures like reference numerals refer to identical or functionally similar elements throughout the separate views, together with the detailed description below, and are incorporated in and form part of the specification to further illustrate embodiments of concepts that include the claimed invention and explain various principles and advantages of those embodiments.

Figure 1:
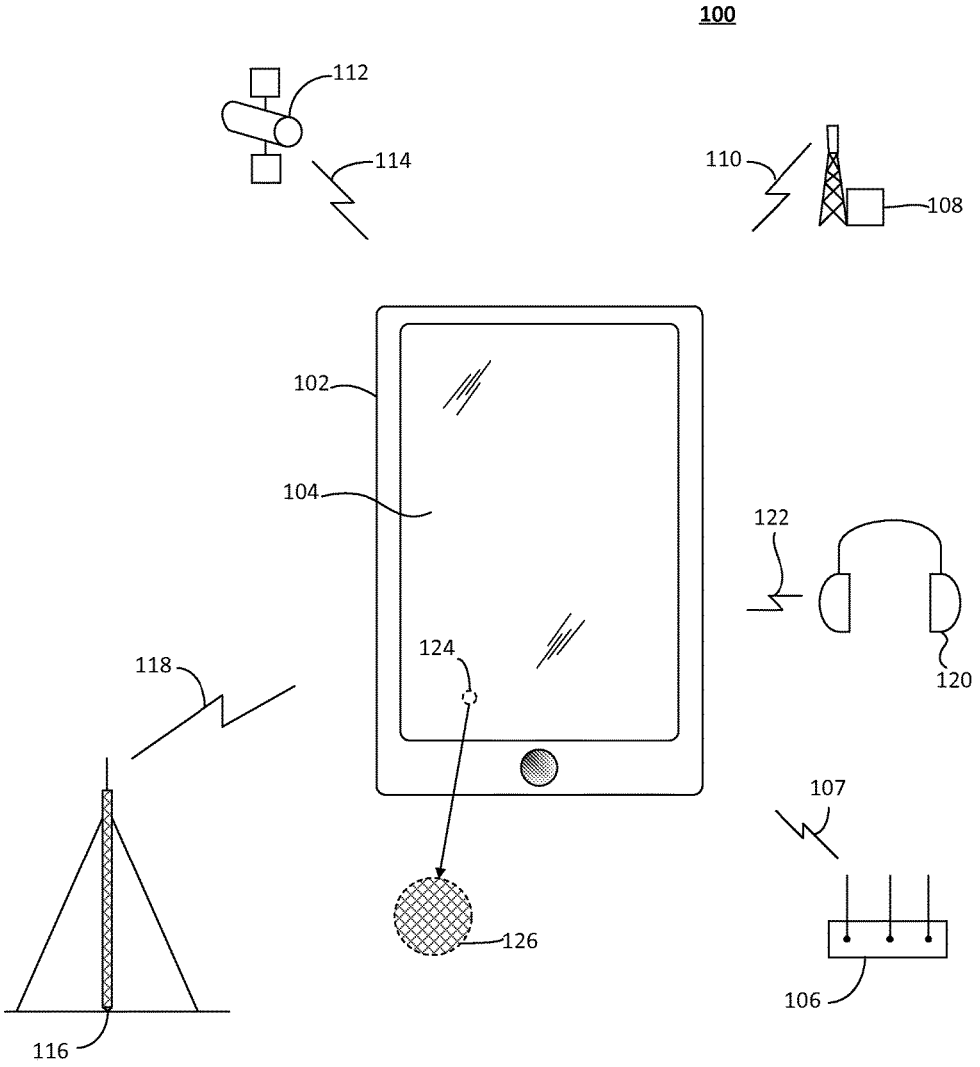
FIG. 1 is a system diagram of a portable electronic device using a metal mesh antenna in an antenna arrangement in accordance with some embodiments.

Those skilled in the field of the present disclosure will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. The details of well-known elements, structure, or processes that would be necessary to practice the embodiments, and that would be well known to those of skill in the art, are not necessarily shown and should be assumed to be present unless otherwise indicated.

DETAILED DESCRIPTION

Problems associated with the prior art, including limitations on space in which an antenna can be located in a portable electronic device, are solved by embodiments disclosed herein, which include a transparent antenna system for a portable electronic device that includes a graphical display having a viewing surface that displays graphical content. A transparent wire mesh is disposed over the viewing surface of the graphical display, through which the viewing surface can be viewed. A radio circuit is coupled to the transparent wire mesh and the transparent wire mesh acts as an antenna element for the radio circuit.

FIG. 1 is a system diagram 100 of a portable electronic device 102 using a metal mesh antenna 126 in an antenna arrangement in accordance with some embodiments. The device 102 can be, for example, a mobile communication device, a tablet device, a general computing device, to name some examples. The device 102 includes a graphical display 104. The graphical display can use any of several well-known and conventional display technologies, including, for example, liquid crystal, light emitting diode (LED), organic LED (OLED), active matrix OLED (AMOLED), electrophoretic (sometimes referred to as "electronic paper"), and so on, or combination of such displays. A metal mesh 126 (which shows a magnified inner view of section 124) is disposed over the graphical display 104. The metal mesh is fabricated of thin metal traces that allow light to pass through it. As such, the metal mesh 126 is transparent, allowing a user an unobstructed view of graphical content displayed on the graphical display. An electrically conductive optically transparent layer is disposed over the graphical display 104, and a section 124 of which is magnified to show a metal mesh 126. Metal mesh 126 is fabricated of microscopic metallic traces assembled to form an electrically conductive layer and is substantially transparent, allowing a user an unobstructed view of graphical content displayed on the graphical display. In reference to "electrically conductive optically transparent layer," the phrases "metal mesh" and "wire mesh" will be used synonymously herein. The metal mesh 126 layer can be covered by a transparent layer of material such as, for example, glass, plastics, and so on. The metal mesh 126 layer can be incorporated into the layers of the graphical display 104.

The portable device 102 includes one or more radio circuits to receive various radio signals and communicate with other radio circuit equipped device. For example, the portable device 102 can include a WLAN transceiver for communicating with a WLAN access point 106 using a WLAN radio protocol 107. WLAN refer to data communications in accordance with the Institute of Electrical and Electronic Engineers (IEEE) specification group 802.11. In embodiments where the portable device 102 is a cellular phone device, it will contain a cellular transceiver to communicate with a cellular network 108 using a cellular radio protocol (e.g. Global Specification for Mobile communication, or GSM). In some embodiments the portable device 102 can include a location determination system for receiving satellite positing signals 114 from positioning satellites 112 (e.g. Global Positioning System). In some embodiments the portable device 102 can include a receiver for receiving commercial radio signals 118 transmitted by a commercial radio system 116 (e.g. Frequency Modulation commercial radio). In some embodiments the portable device 102 can include a personal area network (PAN) transceiver for communicating with a peripheral device 120 using a PAN protocol 122, and example of which includes IEEE specification group 802.15 (which includes the commercially known "BlueTooth" protocol). In some embodiments the portable device can include a radio circuit including a direct broadcast satellite receiver.

Thus, given the numerous radio circuits, receivers and transceivers, and the desire to keep the portable device small, areas for antennas are limited. The metal mesh antenna 126 relies on the fact this it can be fabricated to be transparent to utilize the viewing surface of the graphical display 104. In some embodiments the metal mesh antenna 126 can serve a dual purpose by being incorporated into a touch sensing stack on the graphical display 104. Any radio circuit whose operation can be improved using an antenna, and which can be configured into a portable device, can be coupled to a metal mesh antenna such as metal mesh antenna 126, either as a primary antenna or as a diversity or other supplemental antenna structure.

Figure 2:
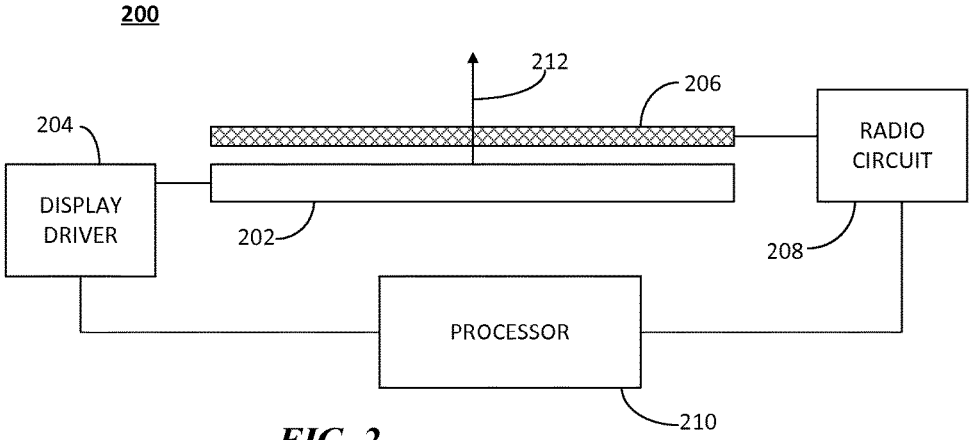
FIG. 2 is a block schematic diagram including a side view of an antenna arrangement for a metal mesh antenna in accordance with some embodiments.

FIG. 2 is a block schematic diagram including a side view of an antenna arrangement 200 for a metal mesh antenna 206 in accordance with some embodiments. The metal mesh antenna 206 is disposed over a graphical display 202. The graphical display contains electrically controllable graphical elements that can be used to form graphical content (e.g. images, video, text), and is driven by a display driver 204, which controls the electrically controllable elements in accordance with graphical data corresponding toe graphical content to be displayed. A radio circuit 208 (e.g. receiver, transceiver) is coupled to the metal mesh antenna 206 and receives radio signal vial the metal mesh antenna 206 and can transmit radio signals via the metal mesh antenna 206 in cases where the radio circuit is a transceiver (or at least a transmitter). Graphical content displayed on the graphical display 202 can be seen through the metal mesh antenna 206, as indicated by arrow 212 as the metal mesh antenna 206 is transparent.

A processor 210 can control both, or either, of the display driver 204 and radio circuit 208. That is, for example, the processor 210 can provide graphical data to the display driver for rendering in the graphical display, and the processor can receive data or signals from the radio circuit 208, as well as provide data or signals to the radio circuit 208 for transmission using radio signals via the metal mesh antenna 206.

Figure 3:
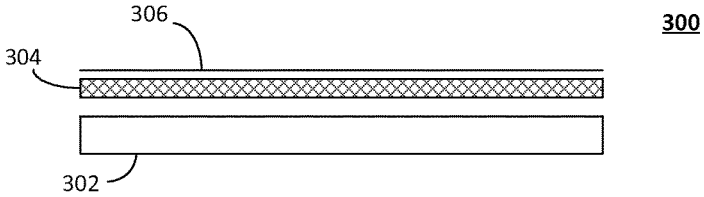
FIG. 3 shows a side view of an antenna arrangement for a metal mesh antenna disposed over a graphical display, in accordance with some embodiments.
Figure 4:
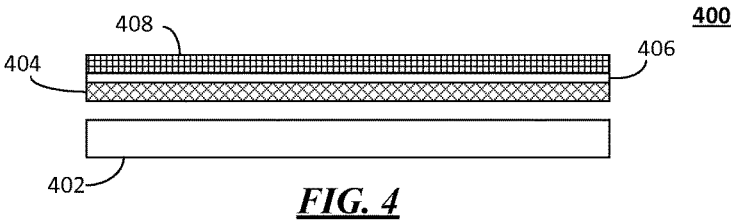
FIG. 4 shows a side view of an antenna arrangement for a metal mesh antenna disposed over a graphical display, in accordance with some embodiments.
Figure 5:
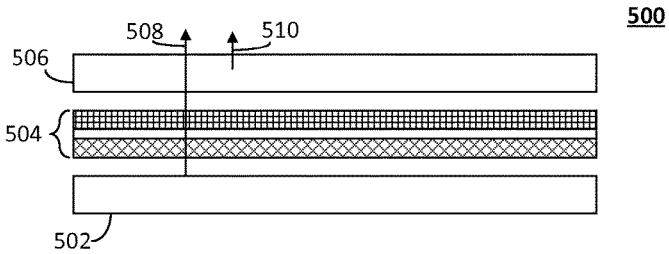
FIG. 5 shows a side view of an antenna arrangement for a metal mesh antenna disposed over a graphical display, in accordance with some embodiments.

FIGS. 3-5 show various embodiments of antenna arrangements using a metal mesh antenna in conjunction with one or more graphical displays.

FIG. 3 shows a side view of an antenna arrangement 300 for a metal mesh antenna 304 disposed over a graphical display 302, in accordance with some embodiments. The graphical display 302 can use any of the known display technologies for displaying graphical content. Although shown separated for clarity here, the metal mesh antenna 304 is overlayed on top of the graphical display 302 so as to be in contact with an upper or top surface of the cover layer 306 of the graphical display. In some embodiments the metal mesh antenna 304 can be printed on, for example, a glass panel that forms the uppermost layer of the graphical display 302 and therefore assembled into the graphical display 302. An electrical connection to a corresponding radio circuit can be made later, during assembly of the portable device, for example.

FIG. 4 shows a side view of an antenna arrangement 400 for a metal mesh antenna disposed over a graphical display 402, in accordance with some embodiments. The metal mesh layer 404 serves a dual purpose and is incorporated into a touch screen panel as a back plane electrode (or could be a front plane electrode in alternate embodiments). The touch screen panel is comprised of several transparent elements arranged in a stack and allows an electrical determination of the location of touch or contact by a user. Touch detection can be performed using capacitive sensing or resistive sensing. Generally a grid system is used where a series of individual conductors in one direction is disposed on first layer and a series of individual conductors arranged orthogonally (i.e. at a 90 degree rotation) to the first layer are disposed on a second layer. This structure is often referred to as an X-Y grid referring to commonly used terms to identify orthogonal axes on a graph. When an electrical change is detected between an X conductor and a Y conductor, the location of the touch that produced the change can be detected. The touch screen panel can further include, for example, a dielectric separator layer 406 which electrically separates the metal mesh 404 from a X-Y grid layer 408. The X-Y conductors can be formed of a transparent conductor material, such as metal mesh or indium tin oxide. The metal mesh layer 404 can be charged with a DC voltage to produce an electric field for the X-Y grid layer 408 to allow capacitive touch sensing. Furthermore, the metal mesh layer 404 can be further connected to a radio circuit through a DC-blocking matching circuit to allow the metal mesh layer 404 to act as an antenna. Likewise, the DC voltage can be applied to the metal mesh layer 404 through a low pass filter to block radio frequency signals. In some embodiments the metal mesh layer 404 can be only an antenna element that is separated from a touch sensing stack layer (i.e. 408) by a dielectric separator 406, where the touch sensing stack layer is a conventional touch sensing arrangement and includes all elements necessary to provide touch location determination to touch determination circuitry (not shown).

FIG. 5 shows a side view of an antenna arrangement 500 for a metal mesh antenna disposed over a graphical display 502, in accordance with some embodiments. The metal mesh antenna is included in a touch sensing stack 504 which can include, for example, layers 404, 406, 408 of FIG. 4. In arrangement 500 the graphical display 502 is a lower graphical display, and an upper, or second graphical display 506 is disposed over the touch sensing stack 504 and the lower graphical display 502. The upper graphical display 506 is made of transparent materials, such as, for example an AMOLED display. Thus, users can see graphical content displayed on the lower graphical display 502 through the touch sensing stack 504 and the upper graphical display 506 as indicated by arrow 508. Likewise graphical information displayed on the upper graphical display 506 can be seen as indicated by arrow 510. Such an arrangement allows, for example, for the lower graphical display 502 to be a low power, non-emissive display, such as an electrophoretic electronic paper display, while the upper graphical display 506 can be an active emissive display. Both the lower and upper displays 502, 506 are driven by a respective display driver (or a common display driver). Content shown on both displays can be coordinated in some applications. In some embodiments low quality content, such as text, can be displayed on the lower graphical display when the upper graphical display is turned off to save power.

It will be appreciated by those skilled in the art that while the form of the metal mesh antenna illustrated in FIGS. 2-5 is generally rectangular, other known arrangements can be used equivalently, including meander portions, parasitic portions, terminated and unterminated stubs (i.e. "F," "J," "H," "U," etc.), and other shapes and conventional antenna geometries that are well known. It is not, therefore, required that the metal mesh have a shape that corresponds to the display surface. In some embodiments the metal mesh can be disposed over a portion of the graphical display, as well as have a portion that extends beyond an edge of the graphical display. In some embodiments multiple mesh antennas can be located over the graphical display, either on the same layer or on different layers.

Figure 6:
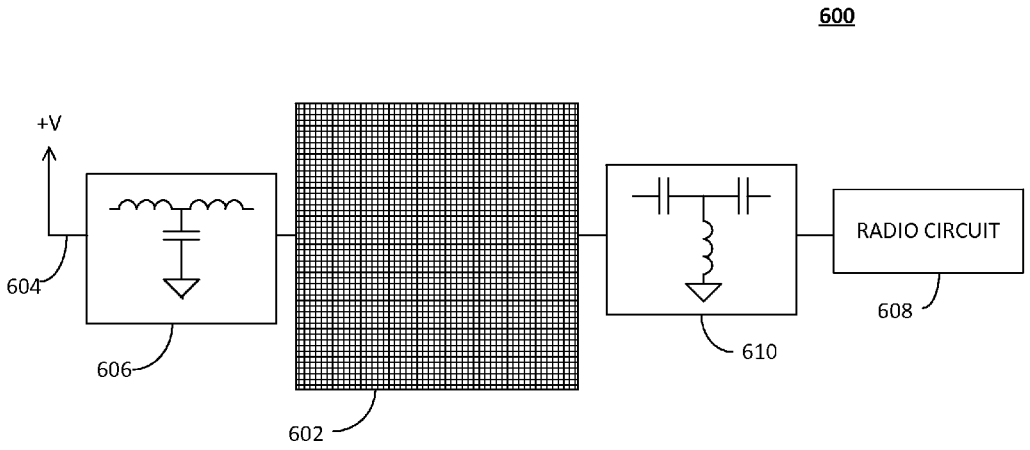
FIG. 6 shows a block circuit schematic for use of a metal mesh in associate with a touch screen and antenna, in accordance with some embodiments.

FIG. 6 shows a block circuit schematic 600 for use of a metal mesh 602 in association with a touch screen and antenna, in accordance with some embodiments. The arrangement can represent, for example, some embodiments in accordance with FIG. 4, and metal mesh 602 can correspond to metal mesh layer 404. The arrangement illustrates embodiments where the metal mesh 602 is used as both a DC electrode and a radio frequency antenna. A DC voltage 604 is connected to the metal mesh 602 through a low pass filter 606, while a radio circuit 608 is connected to the metal mesh 602 through a matching network 610 that blocks DC voltage and current. Thus, radio signals can pass through the matching network 610 but are blocked by the low pass filter 606, preventing the voltage reference providing the DC voltage 604 from loading the metal mesh at radio frequencies, as well as preventing undesired conduction of radio frequency signals into other parts of the device. The matching network is designed to also prevent, for example, clock signal frequencies for any clock signals used in the touch detection circuitry, if any. It is further contemplated that one or more additional radio circuits, operating on different frequencies that radio circuit 608, can likewise be coupled to the metal mesh 602 through a corresponding matching network, like matching network 610, that blocks the frequencies used by radio circuit 608.

Figure 7:
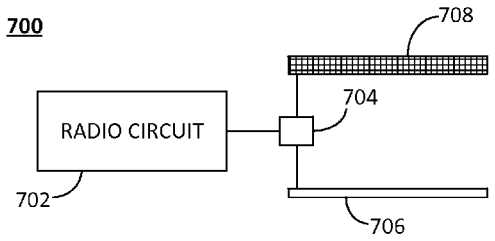
FIG. 7 shows a schematic block diagram of an antenna arrangement using a metal mesh antenna in conjunction with a conventional metal antenna, in accordance with some embodiments.

FIG. 7 shows a schematic block diagram of an antenna arrangement 700 using a metal mesh antenna 708 in conjunction with a conventional metal antenna 706, in accordance with some embodiments. The arrangement 700 illustrates how a transparent metal mesh antenna 708 can be used for frequency or spatial diversity. The metal mesh antenna 708 can be arranged in correspondence with a graphical display, as shown, for example, in FIGS. 2-5, or it can be located elsewhere in the portable electronic device where transparency is required. The metal mesh antenna 708 and the metal (non-mesh) antenna 706 can be coupled to a radio circuit 702 via a combiner 704 that matches the impedance of the radio circuit 702 to each of the metal mesh antenna 708 and the non-mesh metal antenna 706. The non-mesh antenna 706 can be configured to have a different geometry than the metal mesh antenna 708 and can be an internal antenna or an external antenna. In some embodiments the metal mesh antenna 708 can be used for radio signals in a first frequency band while the non-mesh metal antenna 706 can be used for radio signals in a second frequency that is different than the first frequency band. In some embodiments both the non-mesh metal antenna 706 and the metal mesh antenna 708 can be used to receive or transmit the same radio signals to provide spatial diversity.

Figure 8:
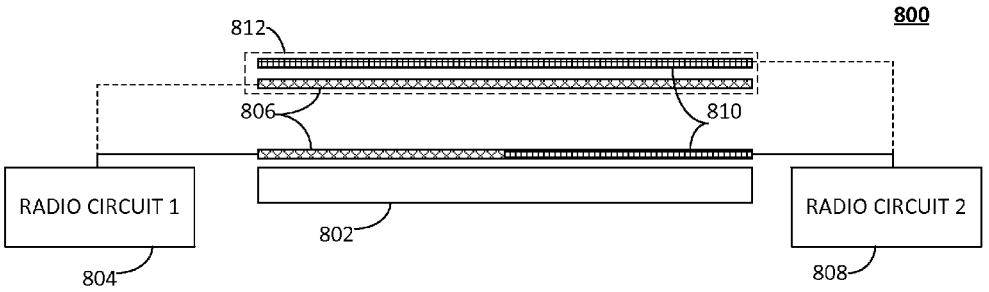
FIG. 8 shows a side view of an antenna arrangement using multiple metal mesh antennas for corresponding radio circuits in conjunction with a graphical display, in accordance with some embodiments.

FIG. 8 shows a side view of an antenna arrangement 800 using multiple metal mesh antennas for corresponding radio circuits in conjunction with a graphical display, in accordance with some embodiments. In the present arrangement 800 two different arrangements are shown, with an optional arrangement 812 being shown in the dashed line box. In general, there is a first metal mesh antenna 806 and a second metal mesh antenna 810. The first metal mesh antenna 806 is connected to a first radio circuit 804 and the second metal mesh antenna 810 is connected to a second radio circuit 808. In some embodiments the first and second metal mesh antennas 806, 810 are located on the same layer adjacent each other over the graphical display 802. The graphical display 802 can be seen through the first and second metal mesh antennas 806, 810 since they are transparent. In some embodiments the first and second metal mesh antennas can be arranged at different levels, as shown in box 812, where second metal mesh antenna 812 is disposed over first metal mesh antenna 806.

Figure 9:
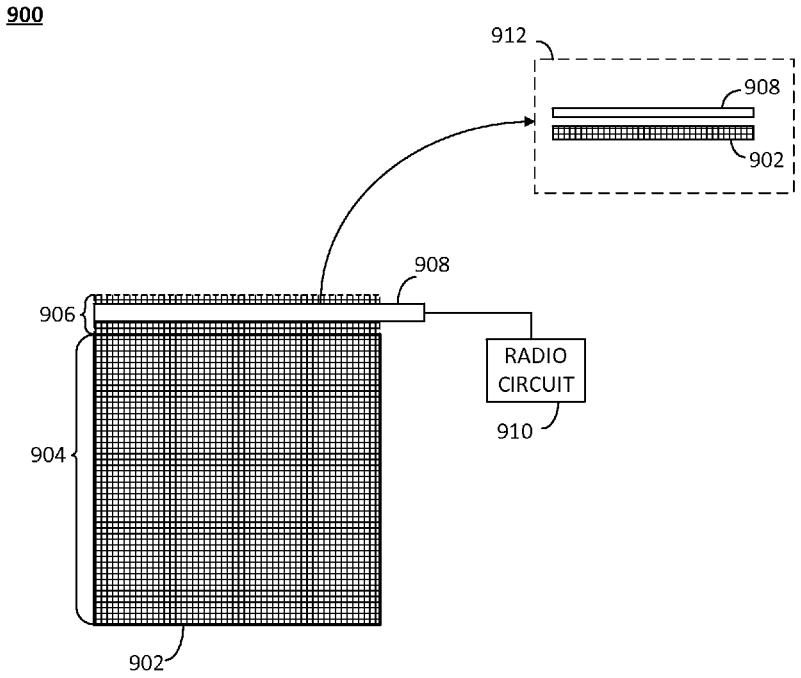
FIG. 9 shows a top plan view of an antenna arrangement including a metal mesh parasitic antenna element, in accordance with some embodiments.

FIG. 9 shows a top plan view of an antenna arrangement 900 including a metal mesh parasitic antenna element, in accordance with some embodiments. Box 912 shows a side elevational view while the remainder of the arrangement 900 is a top plan view. A metal mesh 902 includes a first portion 904 that is disposed over a graphical display, and through which the graphical display can be seen. The metal mesh 902 further includes a second portion 906, that is contiguous with the first portion 904 and which extends beyond an edge of the graphical display. A non-mesh metal antenna element 908 is disposed over the second portion 906 and can be DC coupled to the metal mesh 902 or capacitively coupled to the metal mesh 902 (i.e. as a parasitic antenna element). In some embodiments the non-mesh metal antenna element can be in contact with the metal mesh 902 at the second portion 906, or it can be spaced apart from the second portion 906 (and still be DC coupled, capacitively coupled, or inductively coupled to the second portion 906). A radio circuit 910 is coupled to the non-mesh antenna element 908 for receiving, or transmitting and receiving radio signals via the resulting antenna structure.

As noted, various arrangements known and used in conventional non-mesh metal antenna geometries and arrangements can be implemented in metal mesh components. The metal mesh antenna elements described herein provide the benefit of including an antenna on a portion of a portable electronic device where it was not previously used, i.e. covering the viewing surface of a graphical display. This alleviates the constraints of present-day design goals of reducing size and avoiding external antenna elements while incorporating a growing number of radio circuits for various different radio communication protocols.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. As used herein, the terms "connected" and "coupled" indicate a physical relationship by which energy, force, electrical voltage and/or current can be imparted or transferred among the components that are connected or coupled, and such connections or couplings can include intermediate components. The terms "directly connected" and "directly coupled" indicate an absence of intervening components. As used herein, any components described as being coupled or connected can be directly coupled or connected, or can include unnamed intervening components therebetween.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description as part of the original disclosure, and remain so even if cancelled from the claims during prosecution of the application, with each claim standing on its own as a separately claimed subject matter. Furthermore, subject matter not shown should not be assumed to be necessarily present, and that in some instances it may become necessary to define the claims by use of negative limitations, which are supported herein by merely not showing the subject matter disclaimed in such negative limitations.

We claim:

1. A transparent antenna system for a portable electronic device, comprising:

a graphical display having a viewing surface that displays graphical content, wherein the graphical display is an electronic paper display, the transparent antenna system further comprises a transparent active matrix organic light-emitting diode (AMOLED) display disposed over the transparent touch screen panel overlay, wherein the transparent touch screen panel overlay receives touch input through the AMOLED display for use with graphical content displayed on the AMOLED display by the portable electronic device;

a transparent metal mesh that is disposed over the viewing surface of the graphical display and through which the viewing surface can be viewed, the transparent metal mesh is connected to a direct current (DC) voltage source though a low pass network to further operate as a back plane electrode in a transparent touch screen panel overlay used in conjunction with graphical information displayed by the portable electronic device; and a radio circuit coupled to the transparent metal mesh through a matching network that blocks DC voltage, wherein the transparent metal mesh acts as an antenna element for the radio circuit.

2. The transparent antenna system of claim 1, wherein the graphical display is an electronic paper display, the transparent antenna system further comprises a transparent active matrix organic light-emitting diode (AMOLED) display disposed over the transparent touch screen panel overlay, wherein the transparent touch screen panel overlay receives touch input through the AMOLED display for use with graphical content displayed on the AMOLED display by the portable electronic device.

3. The transparent antenna system of claim 1, further comprising a non-mesh metal antenna element disposed in the portable electronic device that is further coupled to the radio circuit, and wherein the transparent metal mesh is a diversity antenna for the radio circuit.

4. The transparent antenna system of claim 1, wherein the radio circuit operates according to a first radio protocol, the portable electronic device includes at least one additional radio circuit that operates according to a second radio protocol and wherein the transparent antenna system further comprises at least one additional antenna for the at least one additional radio circuit.

5. The transparent antenna system of claim 4, wherein transparent metal mesh is a first transparent metal mesh layer, the at least one additional antenna is formed with a second transparent metal mesh layer that is disposed over the graphical display and which is not DC connected to the first transparent metal mesh layer.

6. The transparent antenna system of claim 1, wherein the radio circuit is one of a commercial frequency modulation (FM) receiver, a satellite positioning receiver, and personal area network transceiver, a local area network transceiver, or a direct broadcast transceiver.

7. The transparent antenna system of claim 1, wherein the radio circuit is a first radio circuit, the system further comprises a second radio circuit coupled to the transparent metal mesh through a matching network that blocks DC and a frequency band used by the first radio circuit, and wherein the matching network used by the first radio circuit blocks frequencies used by the second radio circuit.

8. The transparent antenna system of claim 1, wherein the radio circuit is coupled to the transparent metal mesh by a non-mesh metal antenna element disposed in correspondence with a portion of the transparent metal mesh that extends beyond an edge of the graphical display.

9. A portable electronic device, comprising:

a graphical display having a viewing surface that displays graphical content, wherein the graphical display is an electronic paper display, the portable electronic device further comprises a transparent active matrix organic light-emitting diode (AMOLED) display disposed over the transparent touch screen panel overlay, wherein the transparent touch screen panel overlay receives touch input through the AMOLED display for use with graphical content displayed on the AMOLED display by the portable electronic device;

a display driver coupled to the graphical display and which controls the graphical display to display the graphical content according to graphical data provided to the display driver;

a transparent metal mesh antenna that is disposed over at least a portion of the viewing surface of the graphical display and through which the viewing surface can be viewed, wherein the transparent metal mesh antenna is connected to a direct current (DC) voltage source though a low pass network to further operate as an electrode in a transparent touch screen panel overlay used in conjunction with graphical information displayed by the portable electronic device; and a radio circuit coupled to the transparent metal mesh antenna through a matching network that blocks DC voltage.

10. The portable electronic device of claim 9, further comprising a non-mesh metal antenna element disposed in the portable electronic device that is further coupled to the radio circuit, and wherein the transparent metal mesh antenna is a diversity antenna for the radio circuit.

11. The portable electronic device of claim 9, wherein the radio circuit operates according to a first radio protocol, the portable electronic device includes at least one additional radio circuit that operates according to a second radio protocol and wherein the portable electronic device further comprises at least one additional antenna for the at least one additional radio circuit.

12. The portable electronic device of claim 11, wherein transparent metal mesh antenna is a first transparent metal mesh antenna, the at least one additional antenna is formed with a second transparent metal mesh antenna that is disposed over the graphical display and which is not DC connected to the first transparent metal mesh antenna.

13. The portable electronic device of claim 9, wherein the radio circuit is a commercial frequency modulation (FM) receiver.

14. The portable electronic device of claim 9, wherein the radio circuit is a first radio circuit, the system further comprises a second radio circuit coupled to the transparent metal mesh antenna through a matching network that blocks DC and a frequency band used by the first radio circuit, and wherein the matching network used by the first radio circuit blocks frequencies used by the second radio circuit.

15. The portable electronic device of claim 9, wherein the radio circuit is coupled to the transparent metal mesh antenna by a non-mesh metal antenna element disposed in correspondence with a portion of the transparent metal mesh antenna that extends beyond an edge of the graphical display.

* * * * *